US011444407B2

(12) United States Patent
Zhou et al.

(10) Patent No.: US 11,444,407 B2
(45) Date of Patent: Sep. 13, 2022

(54) MODULAR CONNECTOR ASSEMBLY AND BASE STATION ANTENNA

(71) Applicant: CommScope Technologies LLC, Hickory, NC (US)

(72) Inventors: Yuanyao Zhou, Jiangsu (CN); Jin Liu, Jiangsu (CN); Hongjuan An, Jiangsu (CN); Yujun Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/908,018

(22) Filed: Jun. 22, 2020

(65) Prior Publication Data

US 2021/0006003 A1 Jan. 7, 2021

(30) Foreign Application Priority Data

Jul. 4, 2019 (CN) ..... 201910597017.2

(51) Int. Cl.

| | |
|---|---|
| ***H01R 13/518*** | (2006.01) |
| ***H01R 13/514*** | (2006.01) |
| ***H01R 24/52*** | (2011.01) |
| ***H01Q 1/24*** | (2006.01) |
| ***H01R 103/00*** | (2006.01) |

(52) U.S. Cl.

CPC ..... *H01R 13/518* (2013.01); *H01R 13/514* (2013.01); *H01R 24/52* (2013.01); *H01Q 1/246* (2013.01); *H01R 2103/00* (2013.01)

(58) Field of Classification Search

CPC .... H01R 13/74; H01R 13/745; H01R 13/518; H01R 13/514; H01R 24/52; H01R 2103/00; H01Q 1/246

USPC ..... 439/339, 340, 562, 565

See application file for complete search history.

(56) References Cited

U.S. PATENT DOCUMENTS

| | | | | |
|---|---|---|---|---|
| 7,713,076 | B2 * | 5/2010 | Arts | H01R 13/748 439/248 |
| 7,749,011 | B2 * | 7/2010 | Arts | H01R 13/6315 439/248 |
| 7,963,785 | B2 * | 6/2011 | Arts | H01R 13/6315 439/248 |

(Continued)

FOREIGN PATENT DOCUMENTS

WO 2018231283 A1 12/2018

OTHER PUBLICATIONS

International Search Report and Written Opinion corresponding to International Application No. PCT/US2020/038878 dated Oct. 8, 2020.

*Primary Examiner* — Gary F Paumen
(74) *Attorney, Agent, or Firm* — Myers Bigel, P.A.

(57) ABSTRACT

The present disclosure relates to a modular connector assembly and a base station antenna. The modular connector assembly comprises a support and a plurality of connectors mounted on the support. The support is configured as a one-piece support and provided with a plurality of through holes for mounting of the connectors. Each connector is configured to be formed of a first component and a second component that are connectable to each other. The first component and the second component of each connector are located on opposite sides of the support, respectively, are connected to each other by passing through the through holes in the support, and sandwich the support therebetween, thereby fixedly mounting each connector to the support.

16 Claims, 6 Drawing Sheets

(56) References Cited

U.S. PATENT DOCUMENTS

| | | | | |
|---|---|---|---|---|
| 9,583,854 | B2 * | 2/2017 | Uesaka | H01R 24/50 |
| 9,660,397 | B2 * | 5/2017 | Islam | G02B 6/4452 |
| 10,985,454 | B2 * | 4/2021 | Bisiules | H01Q 21/24 |
| 2007/0287308 | A1 | 12/2007 | Hsieh | |
| 2009/0137145 | A1 * | 5/2009 | Arts | H01R 13/748 439/447 |
| 2009/0317999 | A1 * | 12/2009 | Arts | H01R 13/748 439/248 |
| 2010/0176861 | A1 * | 7/2010 | Dai | H03K 5/133 327/283 |
| 2010/0210129 | A1 | 8/2010 | Arts et al. | |
| 2011/0279140 | A1 | 11/2011 | Uesaka et al. | |
| 2015/0270637 | A1 | 9/2015 | Islam et al. | |
| 2020/0176861 | A1 * | 6/2020 | Bisiules | H02B 1/30 |

* cited by examiner

MODULAR CONNECTOR ASSEMBLY AND BASE STATION ANTENNA

RELATED APPLICATION

The present application claims priority from and the benefit of Chinese Patent Application No. 201910597017.2, filed Jul. 4, 2019, the disclosure of which is hereby incorporated herein in its entirety.

FIELD OF THE INVENTION

The present disclosure relates generally to the field of base station antennas. More specifically, the present disclosure relates to a modular connector assembly for a base station antenna and the base station antenna including the same.

DESCRIPTION OF THE INVENTION

In order to connect input jumpers to a base station antenna, a plurality of connectors are typically fixed on an end cover of the base station antenna to facilitate the insertion of the input jumpers.

FIG. 1 shows a plurality of connectors in the prior art which are fixed to an end cover 1 of a base station antenna, wherein each connector 2 is fixed to the end cover 1 by a plurality of (for example, four) screws 3.

In practice, such means of fixing may have many drawbacks. Firstly, as shown in FIG. 2, in order to fix connectors 2 to the end cover 1 with screws 3, each connector 2 generally includes a flange 4 provided with a plurality of threaded holes 5 so that the connector 2 may be fixed to the end cover 1 by screwing the screws 3 into the threaded holes 5. However, the presence of the flange 4 may increase the size of each connector 2, hindering or preventing the miniaturization of the connector. In addition, the presence of the flange 4 may increase the material cost and processing cost of each connector 2. Secondly, since each connector 2 needs to be fixed onto the end cover 1 by a plurality of screws 3, it may take substantial time to assemble the connector, thereby increasing the labor cost. Finally, it has been found in practice that the presence of the screws 3 may cause "crosstalk" between the connectors 2, which may adversely affect the quality of the communication.

SUMMARY OF THE INVENTION

An object of the present disclosure is to address one or more of the above-mentioned and other issues and to achieve additional advantages.

In the first aspect of the present disclosure, a modular connector assembly is provided which includes a support and a plurality of connectors mounted on the support. The support is configured as a one-piece support and provided with a plurality of through holes for mounting the plurality of connectors. Each of the plurality of connectors is configured to be formed of a first component and a second component, the first component being connectable to the second component. The first component and the second component of each of the plurality of connectors are located on opposite sides of the support, respectively; are connected to each other by passing through one of the plurality of through holes in the support; and sandwich the support therebetween, thereby fixedly mounting each of the plurality of connectors to the support.

According to an embodiment of the present disclosure, each of the plurality of connectors is configured as a coaxial connector that includes an inner contact and an outer contact.

According to an embodiment of the present disclosure, a component selected from the first component and the second component includes the inner contact and/or the outer contact.

According to an embodiment of the present disclosure, a component selected from the first component and the second component includes the inner contact, and a component selected from the first component and the second component includes the outer contact.

According to an embodiment of the present disclosure, the first component is connectable to the second component by a press fit.

According to an embodiment of the present disclosure, the first component is connectable to the second component by a thread fit.

According to an embodiment of the present disclosure, a component selected from the first component and the second component is provided with a boss on an outer circumference thereof, and the boss cooperates with an end surface of a different component selected from the first component and the second component to sandwich the support therebetween.

According to an embodiment of the present disclosure, each of the first component and the second component is provided with a boss on an outer circumference thereof, and the boss of the first component cooperates with the boss of the second component to sandwich the support therebetween.

According to an embodiment of the present disclosure, each of the plurality of through holes in the support has a non-circular shape for preventing a respective connector from rotating therein.

According to an embodiment of the present disclosure, the support is a plastic support.

According to an embodiment of the present disclosure, the modular connector assembly may form an end cover of a base station antenna.

According to an embodiment of the present disclosure, the modular connector assembly is fixed to an end cover of a base station antenna.

According to an embodiment of the present disclosure, the modular connector assembly is fixed to the end cover of the base station antenna by a quick lock nut.

According to an embodiment of the present disclosure, the quick lock nut is a plastic quick lock nut.

According to an embodiment of the present disclosure, the quick lock nut includes a locking element, and the end cover of the base station antenna includes a mating locking element that mates with the locking element of the quick lock nut.

According to an embodiment of the present disclosure, the support of the modular connector assembly includes a mating locking element that mates with the locking element of the quick lock nut.

According to an embodiment of the present disclosure, the locking element of the quick lock nut includes a locking bar. The locking bar is configured to be locked inside a slot included in the mating locking element of the end cover of the base station antenna.

According to an embodiment of the present disclosure, the locking bar is configured to be locked inside a slot included in the mating locking element of the support of the modular connector assembly.

According to an embodiment of the present disclosure, a first locating component selected from the support of the modular connector assembly and the end cover of the base station antenna is provided with a locating post, and a second locating component selected from the support of the modular connector assembly and the end cover of the base station antenna is provided with a locating hole for receiving the locating post.

According to an embodiment of the present disclosure, the locating post is configured as an integral part of the first locating component.

According to an embodiment of the present disclosure, the locating post includes a non-return feature. The non-return feature can prevent the locating post from being withdrawn from the locating hole when the non-return feature passes through the locating hole.

According to an embodiment of the present disclosure, the locating post is configured to comprise a stalk having a first diameter and a head having a second diameter, the second diameter being larger than the first diameter, wherein a lower surface of the head serves as the non-return feature.

According to an embodiment of the present disclosure, the locating post includes two or more resilient components flared away from each other, each of the two or more resilient components including a portion of the stalk and a portion of the head, wherein the head is able to pass through the locating hole when the two or more resilient components are converged, and the lower surface of the head is able to prevent the locating post from being withdrawn from the locating hole when the two or more resilient components are flared away from one another.

According to a second aspect of the present disclosure, a modular connector assembly is provided. The modular connector assembly comprises at least one connector configured to attach to a cable and a support configured to attach to a structure. The at least one connector includes: a first component including a portion of a first contact, the first contact corresponding to a first conductor of the cable; and a second component including a portion of a second contact, the second contact corresponding to a second conductor of the cable; wherein the first component is configured to connect to the second component; and wherein the support is sandwiched between the first component and the second component.

According to a third aspect of the present disclosure, a base station antenna is provided. The base station antenna comprises an end cover and at least one connector assembly mounted on the end cover. The connector assembly is configured as the modular connector assembly according to the present disclosure.

BRIEF DESCRIPTION OF THE DRAWINGS

A plurality of aspects of the present disclosure will be better understood with reference to the following detailed description of the embodiments of the present disclosure in conjunction with the drawings, wherein.

DETAILED DESCRIPTION

Figure 1:
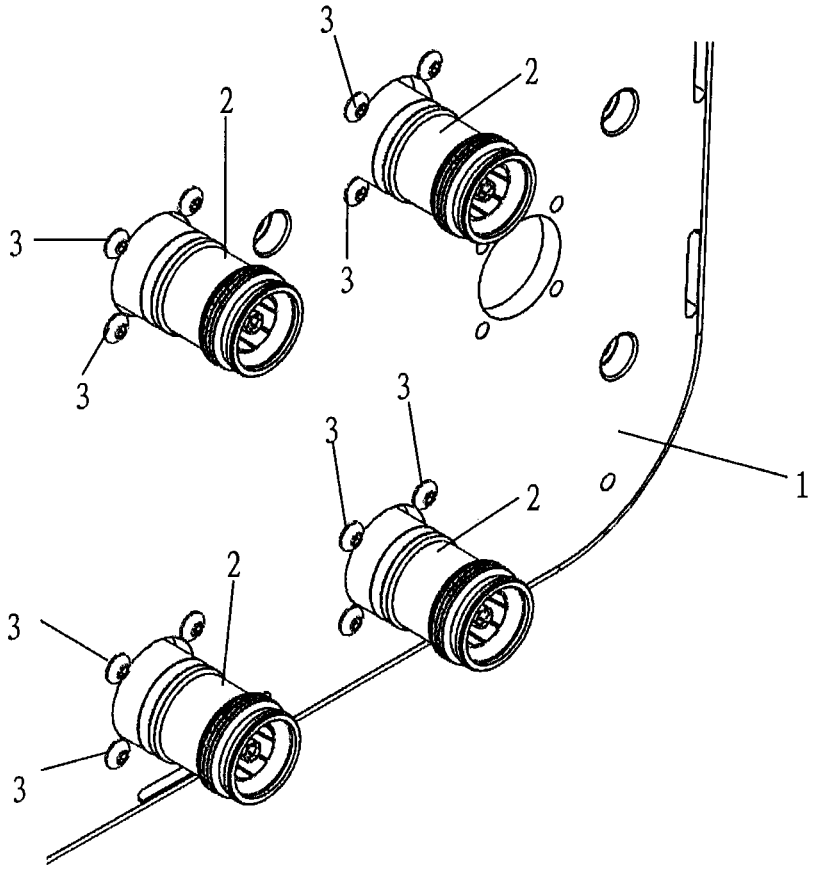
FIG. 1 shows a plurality of connectors in the prior art which are fixed to an end cover of a base station antenna, wherein each connector is fixed to the end cover by a plurality of screws.
Figure 2:
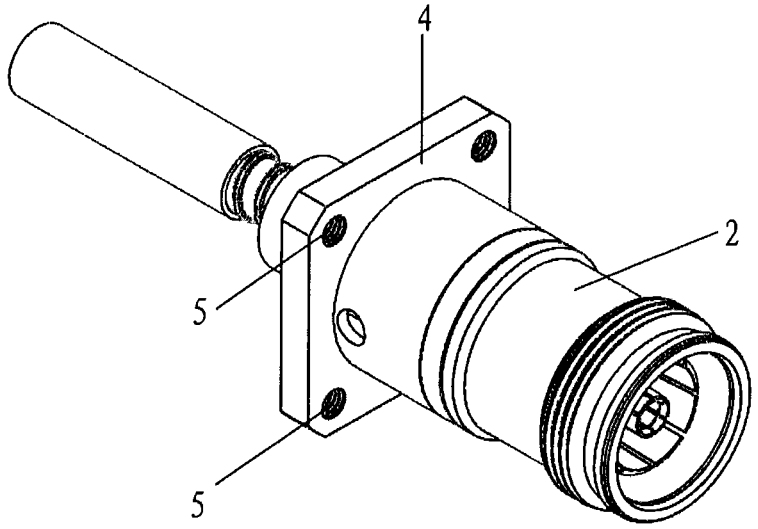
FIG. 2 shows a connector in the prior art which has a flange.

The present disclosure will be described below with reference to the drawings, in which several embodiments of the present disclosure are shown. It should be understood, however, that the present invention may be implemented in many different ways and is not limited to the example embodiments described below. In fact, the embodiments described hereinafter are intended to make a more complete disclosure of the present invention and to adequately explain the scope of the present invention to a person skilled in the art. It should also be understood that the embodiments disclosed herein can be combined in various ways to provide many additional embodiments.

It should be understood that the wordings in the specification are only used for describing particular embodiments and are not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the", as used in the specification, unless clearly indicated, all contain the plural forms. The terms "comprising", "containing" and "including" used in the specification indicate the presence of the claimed features, but do not preclude the presence of one or more additional features. The term "and/or" as used in the specification includes any and all combinations of one or more of the relevant items listed.

The terms "first" and "second" as used in the specification are only for ease of description and are not intended to be limiting. Any technical features represented by the terms "first" and "second" are interchangeable.

In the specification, terms describing spatial relationships such as "up", "down", "top", "bottom" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

In the present disclosure, connectors may be integrated in a support to form a modular connector assembly, and the resulting modular connector assembly may then be fixed to a structure in a quick and simple manner. The structure may generally be any structure containing electrical cables which may be terminated at a connector along a cover plate. For example, the structure may include a base station antenna, and the modular connector assembly may be affixed to the end cover of the base station antenna. In some embodiments, the modular connector assembly may itself form or comprise an end cover for a base station antenna which may replace or overlap an existing end cover. For instance, the connectors may be integrated in a support as disclosed herein, and the support may itself be the end cover for a base station antenna.

Advantageously, the use of metal fasteners (such as screws) may not be required, thus not only significantly shortening the time taken to assemble and fix the connectors, but also avoiding or decreasing "crosstalk" between the connectors, which may be caused by the metal fasteners.

Figure 3:
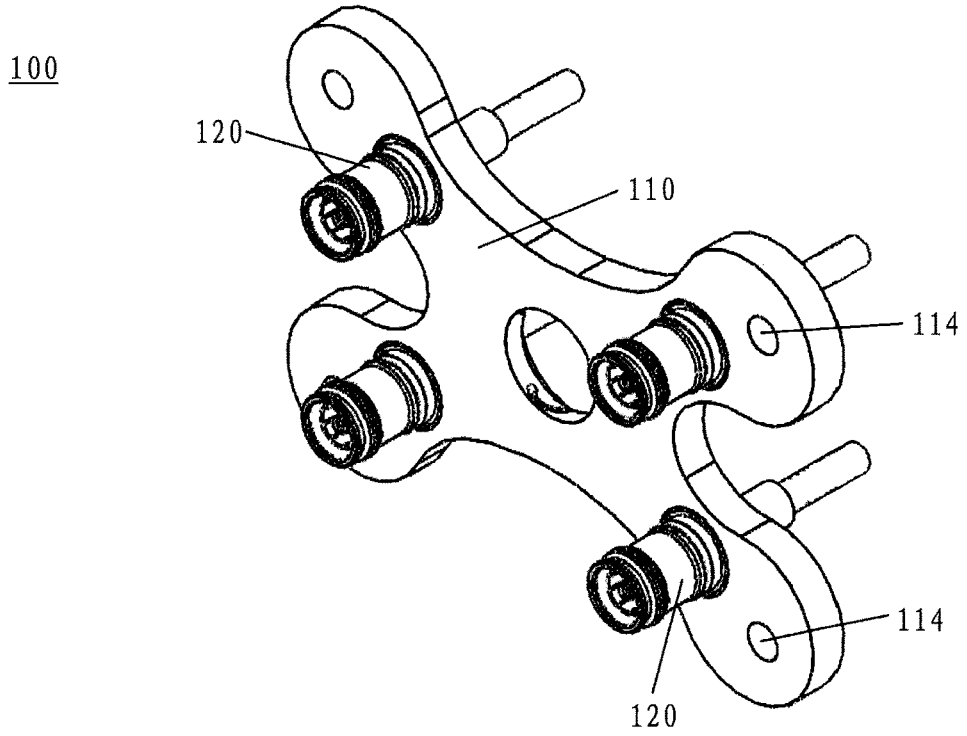
FIG. 3 shows a modular connector assembly according to an embodiment of the present disclosure.
Figure 4:
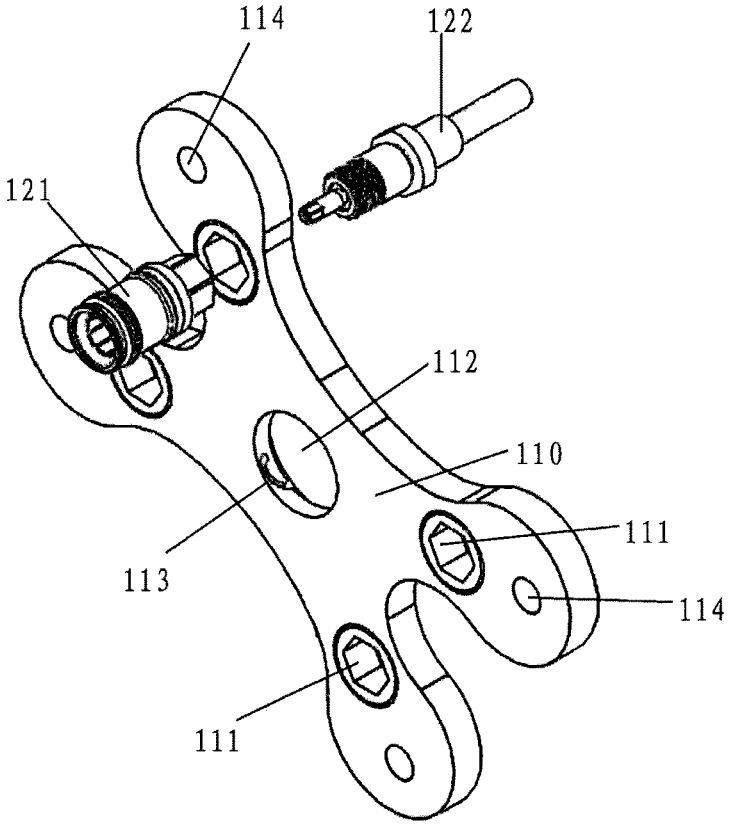
FIG. 4 shows corresponding components of the modular connector assembly shown in FIG. 3.

Referring to FIGS. 3 and 4, a modular connector assembly according to an embodiment of the present disclosure is shown, which is indicated by a numeral reference 100. Generally, the modular connector assembly 100 includes a support 110 and at least one connector 120. As shown, the modular connector assembly includes a plurality of connectors 120 mounted on the support 110. The support 110 is configured as a one-piece support and is provided with a plurality of mounting holes, such as through holes 111, for mounting of the connectors 120. Each connector 120 is configured to be formed of a first component 121 and a second component 122 that are connectable to each other. The first component 121 and the second component 122 of the connector 120 are located on opposite sides of the support 110, respectively; are connected to each other passing the through holes 111 of the support; and sandwich the support 110 therebetween, thereby fixedly mounting the connector 120 to the support 110.

The support 110 may be configured as a support plate and may have any suitable profile. The support 110 may be a plastic or polymer support that is formed by injection molding.

By means of the one-piece support 110, the plurality of connectors 120 can be integrated together to form the modular connector assembly 100 according to the present disclosure. In the embodiment shown in FIGS. 3 and 4, the support 110 may be integrated with four connectors 120 that are distributed in a 2×2 array. However, the support 110 may also be integrated with other numbers of connectors and/or distributed in other arrays. For example, the support 110 may be integrated with the connectors distributed in a 2×3, 2×4, 3×4 array, and the like.

Figure 5A:
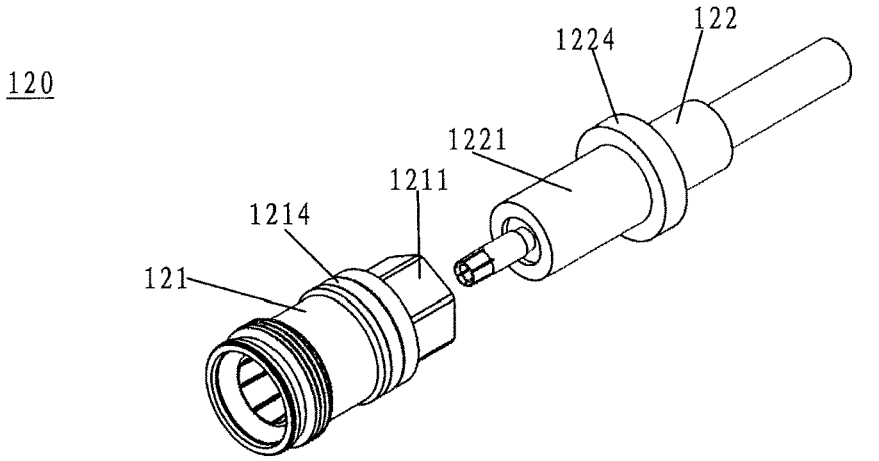
FIG. 5*a* shows a connector according to an embodiment of the present disclosure, wherein a first component and a second component of the connector are connectable to each other by a press fit.
Figure 5B:
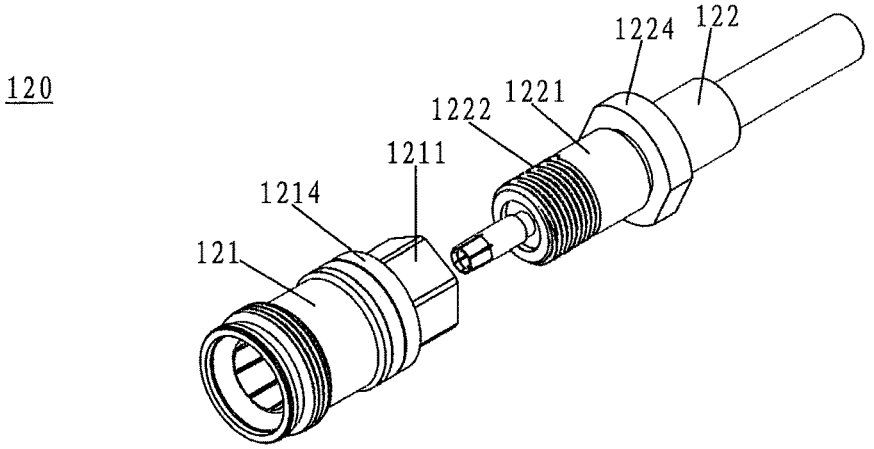
FIG. 5*b* shows a connector according to an embodiment of the present disclosure, wherein a first component and a second component of the connector are connectable to each other by a thread fit.
Figure 5C:
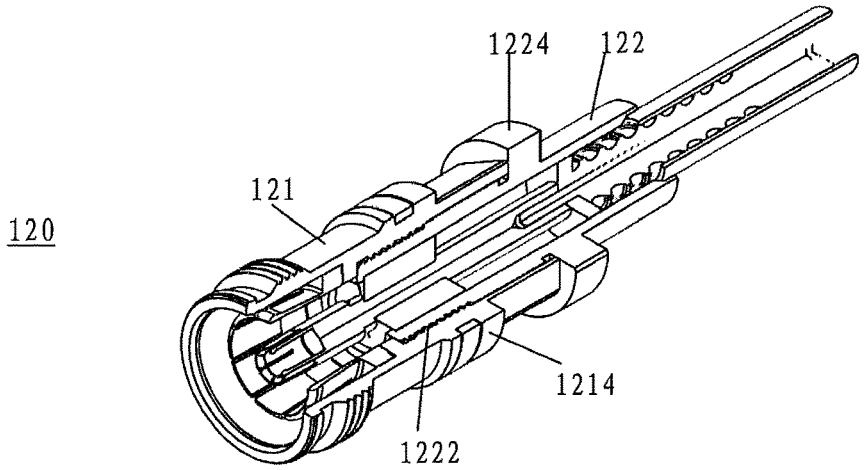
FIG. 5*c* is a cross-sectional view of a connector according to an embodiment of the present disclosure, wherein the first component and the second component have been connected to each other by a thread fit.

Referring to FIGS. 5*a* to 5*c*, specific structures of connectors 120 according to embodiments of the present disclosure are shown. In the embodiments illustrated in FIGS. 5*a* to 5*c*, each connector 120 is shown as a coaxial connector that includes an inner contact and an outer contact. The first component 121 and the second component 122 of the connector 120 may each comprise a part of functional components of the coaxial connector. For example, the first component 121 may comprise a portion of a first contact corresponding to a first conductor of the cable (for example, an outer contact of the coaxial connector corresponding to an outer conductor of the coaxial cable), and the second component 122 may comprise a portion of a second contact corresponding to a second conductor of the cable (for example, an inner contact of the coaxial connector corresponding to an inner conductor of the coaxial cable). Thus, when the first component 121 and the second component 122 are connected together, a coaxial connector with complete electrical connectivity may be formed. In some embodiments, both the inner contact and the outer contact may be included within the first component 121 and/or the second component 122.

According to an embodiment of the present disclosure, the connector 120 comprises a 4.3-10 female connector interface. However, the connector 120 may comprise other types of the connector interfaces, such as a NEX10 connector interface, a 2.2-5 connector interface, an SMA connector interface, an N-type connector interface, a 7/16 radio frequency connector interface, and the like. Additionally, the connector 120 may also be other types of the connectors.

The first component 121 and the second component 122 of the connector 120 may include a first connection feature 1211 and a second connection feature 1221 that mate with each other, respectively. The first component 121 and the second component 122 of the connector 120 may be connected together by means of the first connection feature 1211 and the second connection feature 1221. In one embodiment of the present disclosure, the first connection feature 1211 includes a cylindrical cavity, while the second connection feature 1221 includes a cylindrical body that is receivable in the cylindrical cavity of the first connection feature 1211.

In the embodiment shown in FIG. 5*a*, the first component 121 and the second component 122 are connected together by a press fit (also referred as an "interference fit") of the first connection feature 1211 with the second connection feature 1221. Specifically, the cylindrical cavity of the first connection feature 1211 has an inner diameter slightly smaller than an outer diameter of the cylindrical body of the second connection feature 1221, so that an interference fit is created at an interface between the cylindrical cavity of the first connection feature 1211 and the cylindrical body of the second connection feature 1221, thereby connecting the first component 121 and second component 122 together with the pressure created at the interface (for example, by the elastic deformation thereof).

In the embodiment shown in FIG. 5*b*, the first component 121 and the second component 122 are connected together by a thread fit of the first connection feature 1211 with the second connection feature 1221. Specifically, an internal thread (not shown) is provided on an inner surface of the cylindrical cavity of the first connection feature 1211, and an external thread 1222 is provided on an outer surface of the cylindrical body of the second connection feature 1221. In this way, the first component 121 and the second component 122 may be connected together by screwing the cylindrical body of the second connection feature 1222 into the cylindrical cavity of the first connection feature 1211. FIG. 5*c* shows the thread fit between the first connection feature 1211 and the second connection feature 1221 in the form of a cross-sectional view.

In the embodiments shown in FIGS. 5*a* to 5*c*, a first boss 1214 and a second boss 1224 are disposed on outer circumferences of the first component 121 and the second component 122 respectively. Upon mounting the connector 120 onto the support 110, the first connection feature 1211 of the first component 121 extends from a first side of the support 110 through the through hole 111 in the support 110 and the first boss 1214 of the first component 121 abuts against a first surface of the support 110, while the second connection feature 1221 of the second component 122 is inserted or screwed into the cylindrical cavity of the first connection feature 1211 of the first component 121 from a second side opposite the first side of the support 110 and the second boss 1224 of the second component 122 abuts against a second surface opposite the first surface of the support 110. As a result, the first boss 1214 and the second boss 1224 sandwich the support 110 therebetween by abutting against the first surface and the second surface of the support 110 respectively, thereby allowing the connector 120 to be fixedly mounted onto the support 110.

Returning to FIG. 4, the through hole 111 in the support 110 may be configured to have an inner surface in a non-circular shape in some embodiments. Correspondingly, the first connection feature 1211 of the first component 121 of the connector 120 may be configured to have an outer surface in a corresponding non-circular shape. Alternatively, or additionally, the second connection feature 1221 of the second component 122 may be configured to have an outer surface in the corresponding non-circular shape. The non-circular shape and/or the corresponding non-circular shape may include, for example, a polygon, a rounded polygon, an ellipse, combinations thereof, or substantially any shape having a non-circular form. Thus, for example, when the first component 121 of the connector 120 extends through the through hole 111 in the support 110 and connects to the second component 122, the connector 120 is thereby prevented from rotating inside the through hole 111. For example, the non-circular inner surface of the hole 111 may interfere with the non-circular outer surface of the connector 120 so as to prevent rotation therebetween.

In one embodiment according to the present disclosure, the support 110 may be sandwiched between a first surface on the first component 121 and a second surface on the second component 122. In one example, the end surface of the first component 121 includes a first sandwiching surface and the end surface of the second component 122 includes a second sandwiching surface for sandwiching the support 110 therebetween. In some embodiments, support 110 may be sandwiched between a boss including a sandwiching surface (for example, a first boss 1214 or a second boss 1224) disposed on the first component 121 or the second component 122 and an end surface including a sandwiching surface disposed on the other of the first component 121 or the second component 122. For example, one boss may be provided on the outer circumference of the first component 121 and/or the second component 122. For example, the second component 122 may be provided with a second boss 1224 on its outer circumference. In this embodiment, the support 110 is allowed to be sandwiched between the first component 121 and the second component 122 by an end surface of the first component 121 and the second boss 1224 of the second component 122. Specifically, the first connection feature 1211 of the first component 121 has an outer diameter designed to be larger than an inner diameter of the through hole 111 in the support 110, such that the first connection feature 1211 does not extend into the through hole 111. The second connection feature 1221 of the second component 122 extends from one side of the support 110 through the through hole 111 in the support 110 and projects out from the other side of the support 110. The portion of the second connection feature 1221 that projects out from the other side of the support 110 is inserted or screwed into the cylindrical cavity of the first connection feature 1211 of the first component 121 until the end surface of the first component 121 and the second bosses 1224 of the second component 122 abut against the first and the second surfaces of the support 110 from each side respectively. In this way, the support 110 is sandwiched between the first component 121 and the second component 122 by the end surface of the first component 121 and the second boss 1224 of the second component 122.

In one embodiment, when the through hole 111 in the support 110 has an inner surface in a non-circular shape, a portion of the second connection feature 1221 of the second component 122 to be located in the through hole 111 may be configured to have an outer surface in a corresponding non-circular shape, so as to prevent the connector 120 from rotating inside the through hole 111. Specifically, the second connection feature 1221 of the second component 122 may include a first portion and a second portion. When the connector 120 is mounted onto the support 110, the first portion of the second connection feature 1221 is located inside the through hole 111 of the support 110, whereas the second portion of the second connection feature 1221 extends out of the through hole 111. The first portion of the second connection feature 1221 has a non-circular outer surface that matches the non-circular inner surface of the through hole 111, and the second portion of the second connection feature 1221 has a feature that matches the first connection feature 1211 (for example, a corresponding press-fit feature or thread-fit feature).

Figure 6A:
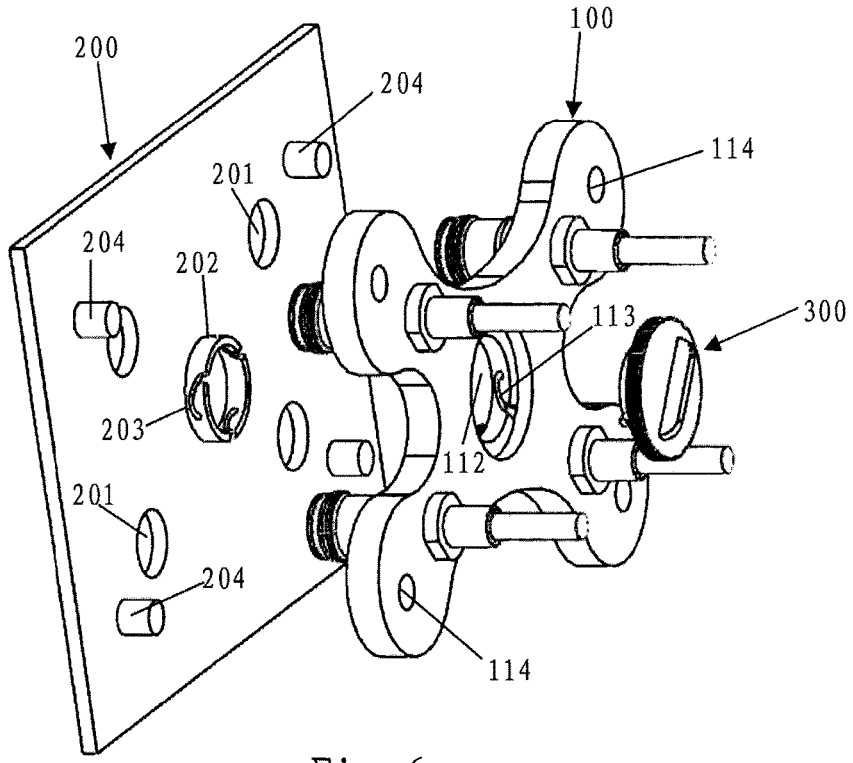
FIGS. 6*a* to 6*c* are schematic views showing the fixation of the modular connector assembly to an end cover of a base station antenna by a quick lock nut according to an embodiment of the present disclosure.
Figure 6B:
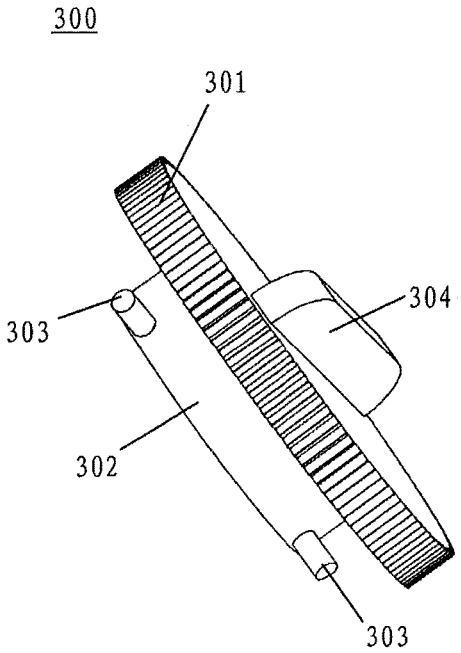
Figure 6C:
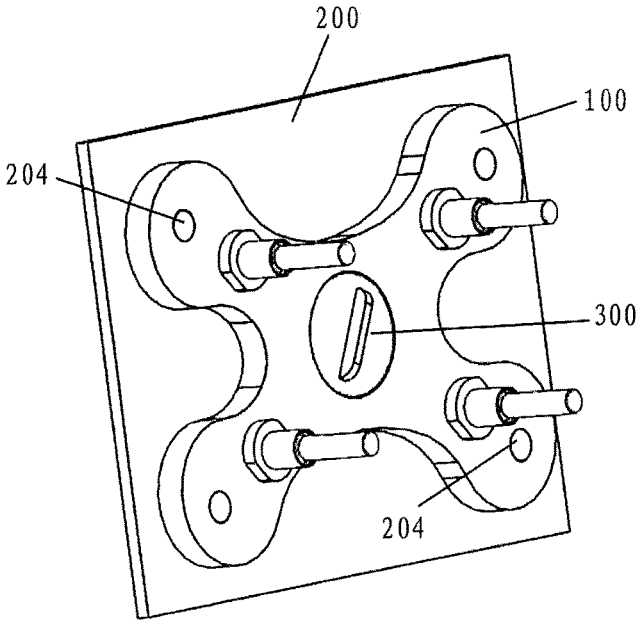

Referring to FIGS. 6*a* to 6*c*, one embodiment of the fixation of the modular connector assembly 100 according to the present disclosure to an end cover 200 of a base station antenna is shown. In the embodiment shown in FIGS. 6*a* to 6*c*, the modular connector assembly 100 is fixed to the end cover 200 of the base station antenna by a quick lock nut 300. The quick lock nut 300 includes a cap 301 and a locking element 302 that extends from a lower surface of the cap 301 in an axial direction. The locking element 302 includes a body and at least one locking bar 303 disposed on an outer circumference of the body. The locking bar 303 projects outward from the body of the locking element 302 in a radial direction. In the embodiment shown in FIG. 6*b*, the locking element 302 comprises three locking bars 303 evenly distributed on the outer circumference of the body in a circumferential direction. An upper surface of the cap 301 of the quick lock nut 300 is provided with a gripper 304 to facilitate gripping and operation of the quick lock nut 300.

Correspondingly, mating locking elements 202 and 112 that cooperate with the locking bar 303 of the quick lock nut 300 are provided on the end cover 200 of the base station antenna and the support 110 of the modular connector assembly 100, respectively. As shown in FIG. 6*a*, the mating locking element 202 of the end cover 200 may include a cylindrical body that projects from the surface of the end cover 200 and at least one slot 203 that runs partly through or entirely through the entire wall thickness of the cylindrical body. The slot 203 is open at top end such that the locking bar 303 is accessible to the slot 203 and movable along the extension path of the slot 203. Further, the mating locking element 112 on the support 110 may be a circular through hole. The circular through hole may have two portions having different diameters along a thickness direction of the support 110 to form a shoulder. A first portion may have a smaller diameter adapted to receive the mating locking element 202 of the end cover 200. A second portion may have a larger diameter adapted to receive the cap 301 of the quick lock nut 300. In some embodiments, a circular through hole of the support 110 may be placed over and around the mating locking element 202 of the end cover 200 and the quick lock nut 300 may be inserted into the mating locking element 202. The locking bars 303 may be inserted into the slot 203 and the quick lock nut 300 may be rotated so that the locking bars 303 follow the extension path of the slot 203, thereby sandwiching and securing the support 110 between the end cover 200 and the cap 301 of the quick lock nut 300. For instance, the quick lock nut 300 may clamp the support 110 against the end cover 200.

In some embodiments, a slot 113 may be provided on an inner surface of the first portion of the circular through hole. The slot 113 is also open at top end such that the locking bar 303 is also accessible to the slot 113 and movable along the extension path of the slot 113. The numbers of the slots 203 and 113 are equal to the number of the locking bars 303 respectively, such that each locking bar 303 is accessible to one corresponding slot 203 and one corresponding slot 113. The extension paths of the slots 203 and 113 are configured as curved extension paths having the same profile, such that when the locking bar 303 is moved along the curved extension paths to the bottom ends of the slots 203 and 113, the locking bar 303 is unable to automatically exit the slots 203 and 113, thereby being locked inside the slots 203 and 113.

In some embodiments, holes 201 may be provided on the end cover 200 of the base station antenna. The connectors 120 of the modular connector assembly 100 may pass through the holes 201. When mounting the modular connector assembly 100 to the end cover 200 of the base station antenna, the connectors 120 of the modular connector assembly 100 pass through the holes 201 in the end cover 200, and the mating locking element 202 on the end cover 200 extends into the mating locking element 112 in the support 110. The end cover 200 and the support 110 may abut against each other or be spaced apart from each other, and the slots 203 and 113 are aligned with each other. The locking bars 303 of the quick lock nut 300 may be inserted into the slots 203 and 113 from the top ends of the slots 203 and 113 (that is, each locking bar 303 is simultaneously put into a pair of slots 203 and 113 which are aligned with each other), and then the quick lock nut 300 may be rotated to move the locking bars 303 along the curved extension path of the slots 203 and 113 until the locking bars 303 are moved to the bottom ends of the slots 203 and 113. At this position, the locking bars 303 of the quick lock nut 300 are locked inside the slots 203 and 113, thereby fixing the modular connector assembly 100 to the end cover 200 of the base station antenna.

The quick lock nut 300 may be a plastic or polymer quick lock nut that may be formed by injection molding. The quick lock nut 300 may also be any other type of quick lock nut known to those skilled in the art.

Locating posts 204 for locating the modular connection assembly 100 may be provided on the end cover 200 of the base station antenna. Correspondingly, locating holes 114 for receiving the locating posts 204 may be provided in the support 110. When the modular connector assembly 100 is mounted on the end cover 200 of the base station antenna, the locating posts 204 may prevent the modular connector assembly 10 from rotating relative to the end cover 200. Moreover, the locating posts 204 may relieve the impact of the external force on the connectors 120, thereby protecting the connectors 120. In the embodiment shown in FIG. 6*a*, the locating posts 204 are configured to have a cylindrical shape.

A locating post is one embodiment of a protrusion for aligning and/or attaching the support to the end cover. The protrusion may be substantially cylindrical or may include substantially square, rectangular, or other polygonal shapes, or other generally prismatic protrusions. A locating hole is one embodiment of a channel configured to receive the locating post or protrusion. Substantially any channel may be used to receive the geometry of the protrusion, including holes and slots, each of which may be blind or pass through the underlying material and have a profile corresponding to the protrusion.

In a variant embodiment according to the present disclosure, each locating post or protrusion may include a non-return feature so that the locating post itself has a locking function. When the non-return feature of a locating post passes through a corresponding locating hole, the non-return feature can prevent the locating post from being withdrawn from the locating hole, thereby fixing the modular connector assembly to the end cover of the base station antenna. For example, the protrusion may be configured to comprise a post or stalk having a first diameter and a head disposed on an end of the post or stalk. The head may have a second diameter, and the second diameter may be larger than the first diameter. A lower surface of the head may serve as the non-return feature. For example, the first diameter of the stalk may be dimensioned to slip through or otherwise pass easily through a locating hole, while the second diameter of the head may be dimensioned to interfere with the third diameter of the locating hole and prevent, impede, or resist the insertion and/or removal of the protrusion. For example, the third diameter may be smaller than the second diameter.

In one embodiment, the head includes a substantially elastic resilient component. The head may be configured to compress, deform, and pass through a locating hole when the resilient component is deformed (for example, elastically deformed). After passing through the locating hole, the head may at least partially expand and return to its undeformed shape and resist withdrawal through the hole. For example, a lower surface of the head may be configured to flare out wider than an upper surface of the head so as to provide easier insertion into the locating hole in one direction while resisting withdrawal from the locating hole in a second and opposite direction.

Figure 7A:
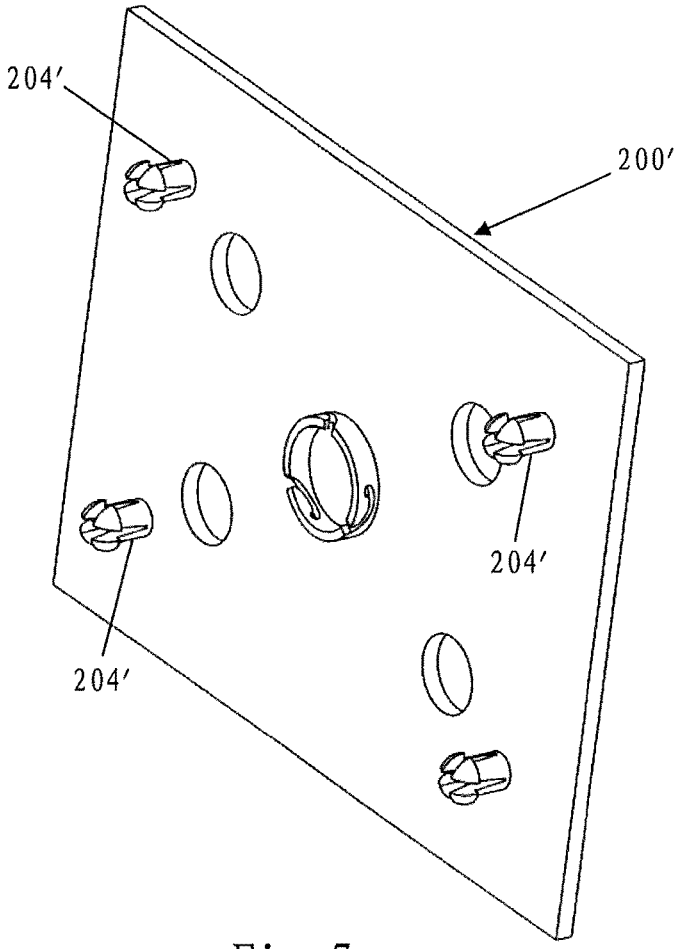
FIGS. 7*a* to 7*d* show another embodiment of the present disclosure, wherein locating posts include non-return features.
Figure 7B:
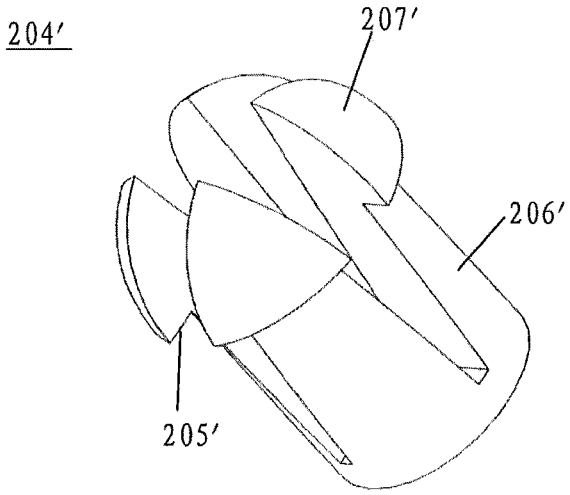

FIGS. 7*a* to 7*d* illustrate an exemplary construction of locating posts 204' having a non-return feature 205', in which the locating posts 204' are provided on an end cover 200' of a base station antenna. As shown in FIG. 7*b*, each locating post 204' is configured to comprise a stalk having a first diameter and a head having a second diameter, the second diameter being larger than the first diameter, wherein each locating post 204' includes two or more flared resilient components. Each of the resilient components includes a portion of the stalk 206' and a portion of the head 207', and a lower surface of the head 207' may serve as the non-return feature 205'.

Figure 7C:
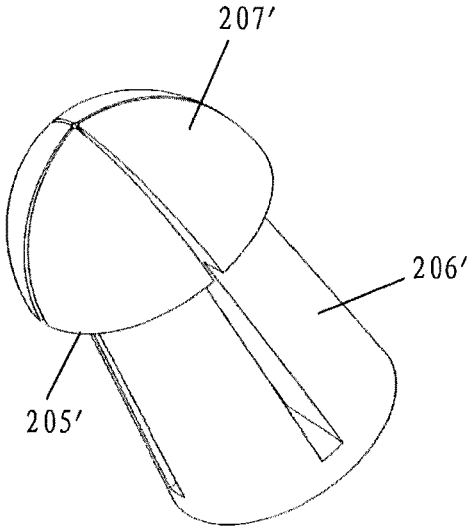

As shown in FIG. 7*c*, the resilient components may be converged under the action of an external force. When the resilient components are converged, for example, while elastically deformed, the head 207' of the locating post 204' can pass through the corresponding locating hole. When the resilient components are flared away from each other, for example, after elastically returning to a rest position, the non-returning features 205' (i.e., the lower surface of the head 20T) of the locating post 204' may prevent the locating post 204' from being withdrawn from the locating hole.

Figure 7D:
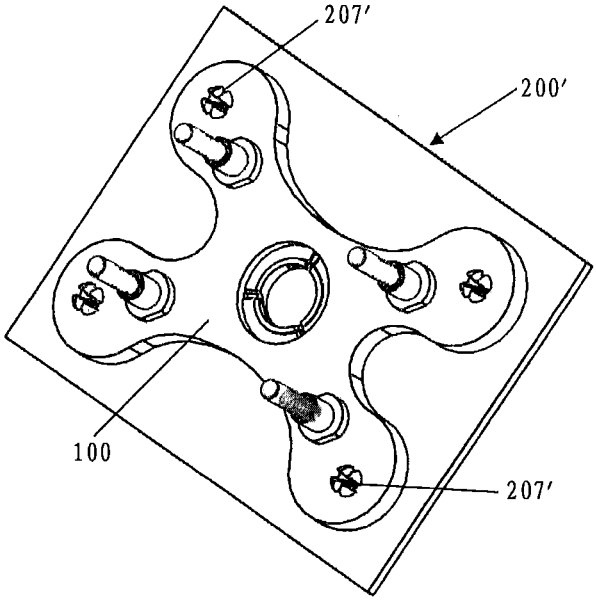

FIG. 7*d* is a schematic view showing the fixation of the modular connector assembly 100 to an end cover 200' of a base station antenna by means of the locating posts 204', in which the heads 207' of the resilient components of the locating posts 204' extend through the corresponding locating hole in the support and are flared away from each other, thereby allowing the modular connector assembly 100 to be locked to the end cover 200' by the heads 207' of the resilient components.

Figure 8:
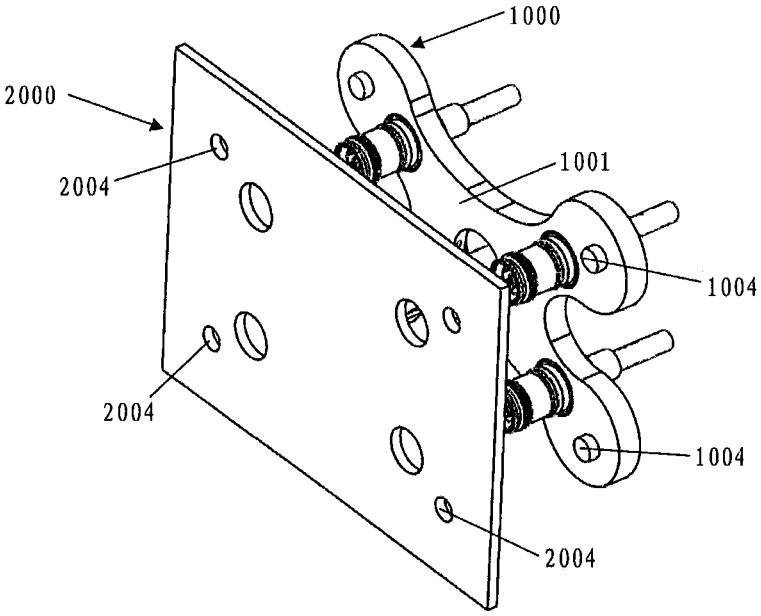
FIG. 8 shows yet another embodiment of the present disclosure, wherein locating posts are disposed on a support of the modular connector assembly, and locating holes are provided in an end cover of the base station antenna.

FIG. 8 shows another variant embodiment according to the present disclosure. In this embodiment, locating posts 1004 are provided on a support 1001 of a modular connector assembly 1000, while locating holes 2004 are provided in an end cover 2000 of a base station antenna. In this embodiment, although the locating posts 1004 are shown in a cylindrical shape, they may also be configured to be of the structure as shown in FIGS. 7*a* to 7*d*.

In the embodiments according to the present disclosure, the locating posts (for example, locating posts 204, 204', and/or 1004) may be configured as an integral part of the end cover 200 or the support 1001. For example, the locating posts may be integrally formed with the end cover 200 or the support 1001 by injection molding.

The modular connector assembly according to the present disclosure may not require the use of metal fasteners such as screws, which not only reduces the number of parts that need to be used and shortens the time it takes to assemble and fix the connectors, but may also avoid or reduce "crosstalk" between the connectors which may be caused by metal fasteners, such as screws. In addition, it is not necessary to provide the connectors with a corresponding structure (for example, a flange) for the fasteners, advantageously aiding the miniaturization of the connectors.

Additionally, when the locating posts include non-return features, it may be possible to fix the modular connector assembly to the end cover of the base station antenna by the locating posts themselves without using the quick lock nut. This further reduces the number of parts required to fix the modular connector assembly and further reduces the time it takes to assemble and fix the connectors.

Although exemplary embodiments of this disclosure have been described, those skilled in the art should appreciate that many variations and modifications are possible in the exemplary embodiments without departing from the spirit and scope of the present disclosure. Accordingly, all such variations and modifications are intended to be included within the scope of this disclosure as defined in the claims.

What is claimed is:

1. A modular connector assembly comprising a support and a plurality of connectors mounted on the support, characterized in that the support is configured as a one-piece planar support and provided with a plurality of through holes for mounting the plurality of connectors;

each of the plurality of connectors is configured to be formed of a first component and a second component, the first component being connectable to the second component to form each respective connector, wherein the first component includes an inner contact and the second component includes an outer contact and is devoid of an inner contact;

wherein the first component and the second component of each of the plurality of connectors are located on opposite sides of the support, respectively; are connected to each other by passing through one of the plurality of through holes in the support; and sandwich the support therebetween, thereby fixedly mounting each of the plurality of connectors to the support.

2. The modular connector assembly according to claim 1, characterized in that each of the plurality of connectors is configured as a coaxial connector that includes an inner contact and an outer contact.

3. The modular connector assembly according to claim 2, characterized in that a component selected from the first component and the second component includes the inner contact and/or the outer contact.

4. The modular connector assembly according to claim 2, characterized in that a component selected from the first component and the second component includes the inner contact, and a different component selected from the first component and the second component includes the outer contact.

5. The modular connector assembly according to claim 1, characterized in that the first component is connectable to the second component by a press fit.

6. The modular connector assembly according to claim 1, characterized in that the first component is connectable to the second component by a thread fit.

7. The modular connector assembly according to claim 1, characterized in that each of the first component and the second component is provided with a boss on an outer circumference thereof, and the boss of the first component cooperates with the boss of the second component to sandwich the support therebetween.

8. The modular connector assembly according to claim 1, characterized in that each of the plurality of through holes in the support has a non-circular shape for preventing a respective connector from rotating therein.

9. The modular connector assembly according to claim 1, characterized in that the support is a plastic support.

10. The modular connector assembly according to claim 1, characterized in that the modular connector assembly forms an end cover of a base station antenna.

11. The modular connector assembly according to claim 1, characterized in that the modular connector assembly is fixed to an end cover of a base station antenna.

12. The modular connector assembly according to claim 11, characterized in that the modular connector assembly is fixed to the end cover of the base station antenna by a quick lock nut.

13. The modular connector assembly according to claim 12, characterized in that the quick lock nut is a plastic quick lock nut.

14. The modular connector assembly according to claim 12, characterized in that the quick lock nut includes a locking element, and the end cover of the base station antenna includes a mating locking element that mates with the locking element of the quick lock nut.

15. The modular connector assembly according to claim 11, characterized in that a first locating component selected from the support of the modular connector assembly and the end cover of the base station antenna is provided with a locating post, and a second locating component selected from the support of the modular connector assembly and the end cover of the base station antenna is provided with a locating hole RN receiving the locating post.

16. A modular connector assembly comprising at least one connector configured to attach to a cable and a support configured to attach to a structure, characterized in that:

the at least one connector includes:

a first component including a portion of a first inner contact, the first inner contact corresponding to a first inner conductor of the cable; and a second component including a portion of a second outer contact, the second outer contact corresponding to a second outer conductor of the cable and being devoid of an inner contact;

wherein the first component is configured to connect to the second component; and wherein the support is sandwiched between and abutted by the first component and the second component when the first component and the second component are brought together to form the at least one connector.

* * * * *